US006716110B1

(12) United States Patent
Ballow

(10) Patent No.: US 6,716,110 B1
(45) Date of Patent: Apr. 6, 2004

(54) GOLF PUTTER

(76) Inventor: Paul Ballow, 396 Twitchell Rd., Mansfield, OH (US) 44903

( * ) Notice: Subject to any disclaimer, the term of this patent is extended or adjusted under 35 U.S.C. 154(b) by 0 days.

(21) Appl. No.: 10/445,623

(22) Filed: May 27, 2003

(51) Int. Cl.[7] ..... A63B 69/36; A63B 53/04

(52) U.S. Cl. ..... 473/242; 473/252; 473/340; 473/342; 473/349; 473/345; 473/305; 473/313

(58) Field of Search ..... 473/324, 334, 473/335, 336, 337, 338, 339, 340, 341, 342, 345, 346, 349, 350, 242, 249, 250, 251, 252, 253, 254, 255, 256, 305, 313

(56) References Cited

U.S. PATENT DOCUMENTS

| | | | | | |
|---|---|---|---|---|---|
| 3,841,640 | A | * | 10/1974 | Gaulocher | 473/249 |
| 4,688,798 | A | | 8/1987 | Pelz | |
| 4,754,976 | A | | 7/1988 | Pelz | |
| 4,872,683 | A | * | 10/1989 | Doran et al. | 473/249 |
| 5,482,281 | A | | 1/1996 | Anderson | |
| D379,645 | S | | 6/1997 | Cameron | |
| 5,653,645 | A | | 8/1997 | Baumann | |
| 5,672,120 | A | | 9/1997 | Ramirez et al. | |
| 5,685,784 | A | | 11/1997 | Butler | |
| 5,746,664 | A | | 5/1998 | Reynolds, Jr. | |
| 5,769,736 | A | * | 6/1998 | Sato | 473/335 |
| 5,830,078 | A | | 11/1998 | McMahan | |
| 6,102,814 | A | | 8/2000 | Grace et al. | |
| 6,273,828 | B1 | | 8/2001 | Wood et al. | |
| 6,280,349 | B1 | * | 8/2001 | Cook | 473/345 |
| 6,379,258 | B1 | | 4/2002 | To | |
| 6,471,600 | B2 | | 10/2002 | Tang et al. | |
| 6,506,125 | B2 | | 1/2003 | Helmstetter et al. | |

OTHER PUBLICATIONS

U.S. Golf Assoc., A Guide to the Rules on Clubs and Balls [on line] [retrieved on Mar. 3, 2003] Retrieved from Internet <URL: http://www.usga.org/test_center/guide/club-head.htm, 4. Clubhead, 8 pages.

Scotty Cameron Futura Putter, [on–line], [retrieved on Mar. 24, 2003] Retrived from Titleist on–line Catalog using Internet <URL: http://www.titleist.com/putters/detail-s.asp?id=3, p. 1 of 2.

* cited by examiner

*Primary Examiner*—Sebastiano Passaniti
(74) *Attorney, Agent, or Firm*—Renner, Otto, Boisselle & Sklar LLP

(57) ABSTRACT

A golf putter head having a rearward center of gravity. The head comprises a body having a face portion, a sole portion and an aft-mass portion, where the body is at least partially made from a first material. The putter head also has a cap made from a second material having a lower density than the first material. The body and cap define a void and the center of gravity of the putter head is within the void.

20 Claims, 2 Drawing Sheets

GOLF PUTTER

FIELD OF THE INVENTION

The present invention relates to a putter-type golf club, and more specifically to a golf putter head.

BACKGROUND OF THE INVENTION

Putting is often considered the most difficult part of the game of golf. When putting, the golf ball must be hit with a precise amount of force and in a precise direction. If not, the golf ball either will fail to reach the cup (i.e. hole) or it will miss the cup on one side or the other. Various attempts have been made to design putters and in particular putter heads which facilitate imparting the precise amount of force and direction to a golf ball to successfully complete a putt.

Most putter head designs are variations of either a blade type putter head or a mallet type putter head; both these types of putter heads are affected by parameters which can cause mishit and misdirected putts. The mallet-style putter has a relatively large, solid head that usually is semi-circular in shape when viewed from above, while the blade-style putter has a relatively narrow or blade-like head. Each type of putter includes a generally flat strike face for hitting the golf ball, usually set at a loft of about 5° or less. Accuracy of the putt is dependent on where the strike face impacts the ball, as well as on the orientation of the strike face at impact. Among the parameters that can cause mishit puts are the width of the putter head face (FW), the length of the putter head (L), and the location of the putter head center of gravity (CG).

The face or front of the putter head is that portion of the head which actually makes direct contact with the golf ball. Most blade type and mallet type putter heads employ a face that is usually as wide or almost as wide as the widest portion of the head. Typically, blade type putter heads have face widths greater than 4 inches while mallet type heads have face widths greater than 3 inches. The length of the putter head is defined as the distance from the face to the back the putter head. The width of the putter head face and the length of the putter head are factors in successful putting in that they affect the pre-putt alignment of the putter head, the impacting of the golf ball on the "sweet spot" of the putter face, and the location of the putter head center of gravity.

Pre-putt alignment of a blade or mallet type putter head normally is accomplished by determining a line of sight to the cup and then positioning the putter head behind the golf ball on that line of sight with the putter head face perpendicular to the line of sight. If the face of the putter head is not perpendicular to the line of sight when the putter head impacts the ball, misdirection of the putt will occur. As the length of the putt increases, even a small misalignment results in a missed putt. The alignment procedure could be simplified and improved by reducing putter head face width (FW) so as to allow only a small facial area to impact the golf ball, increasing putter head length (L), and putting an alignment stripe on the top of the putter head. In order to ensure that the putter head conforms to USGA rules, however, the face width must be wider than the head is long. The USGA rules relating to putters are incorporated herein by reference.

Because USGA rules limit the reduction of the face width to head length ratio, many putters are designed so that the sweet spot size is increased. Impacting the golf ball on the sweet spot of the putter face involves determining the location of this spot and then consistently hitting the ball there. The sweet spot can be defined as a small area (typically having a width no greater than one half inch) on the face of a putter head that can impact a golf ball with the required force utilizing the shortest possible putter stroke to successfully complete a putt. The sweet spot is normally located such that a vertical middle plane will bisect the sweet spot, the putter head face, and pass through the putter head center of gravity. For example, the sweet spot on a blade type putter head face four and one half inches wide would normally be centered on the putter head face two and a quarter inches from either end of the blade. Error in the form of weak and ineffectual putts is introduced when the golf ball does not impact the sweet spot, and this error becomes greater as the distance between the sweet spot and the point of impact increases. Also, impacting the golf ball at or near the end of a mallet or blade type putter head can cause putter head twist resulting in misdirected putts.

The location of the center of gravity of the putter head is also a factor in successful putting in that increasing the distance between the center of gravity and the face of the putter head allows the golfer to take a shorter more controlled backswing of the putter head resulting in a higher percentage of positive contact with the golf ball. For a putter head of uniform density, this distance will increase as the length of the putter head is increased.

In recent years, golf club technology has evolved rapidly, with many different modifications having been made to the general structure of golf club heads, including putter heads. For example, golf club heads have been designed with back face undercuts having inserted weights, with holographic inserts on the trailing edge bevel, with cut-out sections extending through both the sole and crown of the club head, and with a strike face having two planar surfaces, one being offset from the other. Other more recent design initiatives include the placement of a "horseshoe" as an aft-mass object so that the majority of the weight of the putter head is in the rear of the club, rather than the face and body, thus altering the club's weight distribution. This design is embodied in the new Titleist® Futura putter. Putter heads have also been designed with recessed back cavities. One of the most popular types of these putters are the Callaway "2-Ball" putters, which are described in U.S. Pat. No. 6,471,600 to Tang, et al. and U.S. Pat. No. 6,506,125 to Helmstetter, et al.

Thus, while numerous modifications have been made to golf club heads in recent years, there is a continued need in the art to improve functionality, look, and feel of putters while conforming to USGA requirements.

BRIEF SUMMARY OF THE INVENTION

According to an aspect of the present invention a golf putter head includes: a body having a face portion, a sole portion and an aft-mass portion, the body being at least partially made from a first material; and a cap made from a second material, the second material having a lower density than the first material; wherein the body and cap define a void and wherein the center of gravity of the golf putter head is within the void.

According to another aspect of the present invention, a golf putter head includes: a body having a face portion, a sole portion and an aft-mass portion, the body being at least partially made from a body material, the face portion being greater in width than the aft-mass portion, but less in width than the width of the putter head at its widest point; a cap made from a light material, the light material having a lower density than the first material; and at least one aft-mass weight being made from a heavy material having a higher density than the body material; wherein the body and cap define a void and wherein the center of gravity of the golf putter head is within the void.

DETAILED DESCRIPTION OF THE INVENTION

Figure 1:
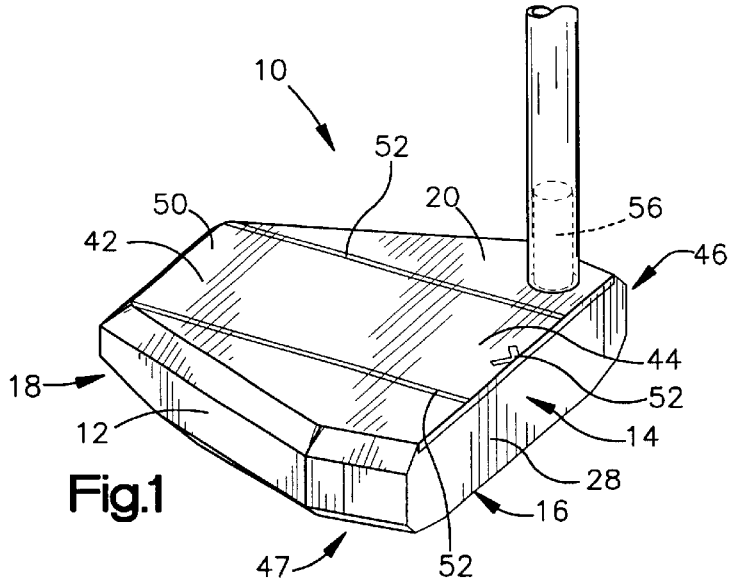
FIG. 1 is a top perspective view from the toe of the putter head of the present invention.
Figure 2:
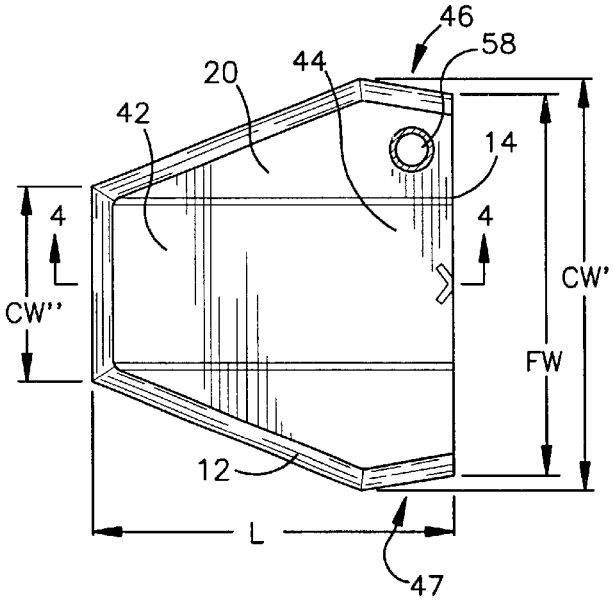
FIG. 2 is a top view of the putter head of the present invention.
Figure 3:
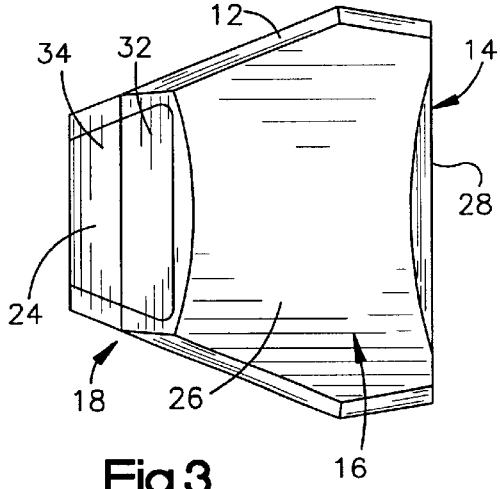
FIG. 3 is a bottom view of the putter head of the present invention.
Figure 4:
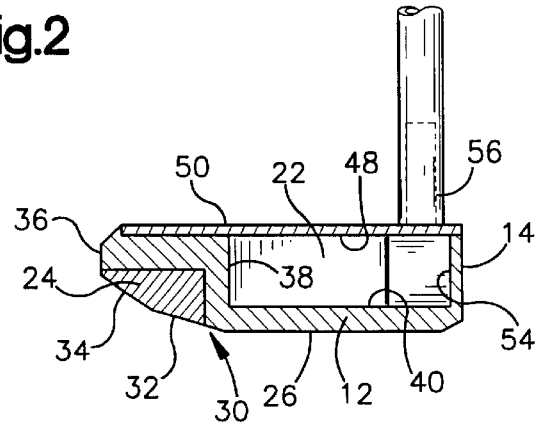
FIG. 4 is a side view of the putter head of the present invention.
Figure 5:
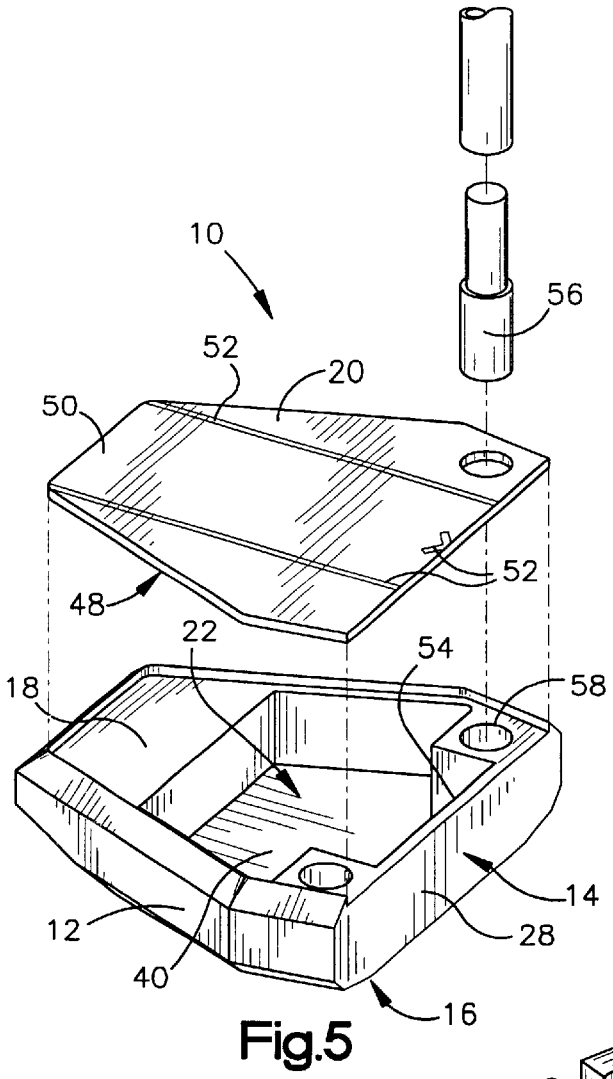
FIG. 5 is a top view of the body of the putter head of the present invention.
Figure 6:
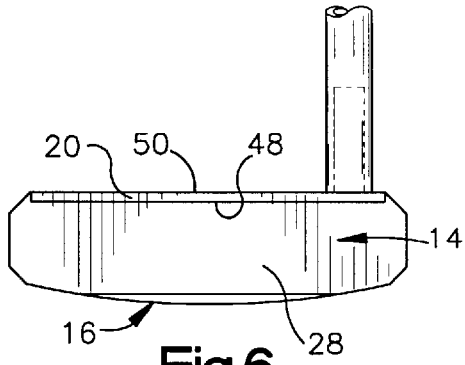
FIG. 6 is a front view of the putter head of the present invention.

As is shown in FIGS. 1–7, a golf putter head of the present invention is generally designated 10. Depending on the putter length, the club head 10 may be designed lighter or heavier, but an exemplary head 10 has a weight that comports with USGA rules and regulations. For example, the head 10 may weigh from about 280 grams to about 510 grams. In other example, the weight may be from about 300 grams to about 380 grams. In one embodiment, the head 10 weighs about 340 grams. Also, the weight of head 10 may vary depending on the length of the putter. For example, a 33 inch putter might weigh about 350 grams, while a 36 inch putter might weigh about 320 grams.

The head 10 has a body 12 that is at least partially composed of a first material, such as a suitable metal. Suitable metals for the body 12 include aluminum, steel, stainless steel, titanium, titanium alloys, carbon steel, bronze, and the like. The body 12 may be formed as a single structure or from multiple structures using known techniques. Such techniques may include investment casting, milling, welding forged or formed pieces, and the like. In addition, the body 12 may also be composed of any metal or metal alloy having a density greater than that of aluminum and less than that of steel. In an exemplary embodiment, the body 12 is aluminum. The body 12 may weigh from about 230 grams to about 495 grams and may make up from about 82 percent to about 97 percent of the weight of the head 10. In an exemplary embodiment, the body 12 weighs from about 260 grams to about 360 grams and makes up from about 86 percent to about 94 percent of the weight of the head 10. In another exemplary embodiment, the body 12 weighs from about 315 grams and makes up about 92 percent of the weight of the head 10. The weight of the body 12 may also be adjusted for various head 10 weights.

The body 12 has a face portion 14, a sole portion 16 and an aft-mass portion 18. Attached to the body 12 is a cap 20. The face portion 14, the sole portion 16, the aft-mass portion 18, and the cap 20 form a void 22. Because an ideal design of the putter head 10 may include areas that are void of material, such as void 22, the cap 20 functions to cover any void areas, thereby making the head 10 more visually pleasing and less distracting to the user. The cap 20 is at least partially composed of a second material having a lower density than the first material. Suitable materials for the cap 20 include carbon fiber, plastics, composite plastics, Kevlar, fiberglass, and the like. In an exemplary embodiment, the cap 20 is a carbon fiber material. The cap 20 may weigh from about 15 grams to about 50 grams and may make up from about 3 percent to about 18 percent of the weight of the head 10. In an exemplary embodiment, the cap 20 weighs from about 20 grams to about 40 grams and makes up from about 5 percent to about 13 percent of the weight of the head 10. In another exemplary embodiment, the cap 20 weighs from about 25 grams and makes up about 7 percent of the weight of the head 10. The comparatively light weight of the cap 20 allows the center of gravity CG to be moved rearward from the face portion 14.

The aft-mass portion 18 of the head 10 may also have at least one aft-mass weight 24 that is at least partially composed of a third material that has a higher density than either the first material or second material. Suitable materials for the aft-mass weight 24 include brass, steel, tungsten, metal alloys, and the like. The aft-mass 24 may weigh from about 12 grams to about 156 grams and may make up from about 4 percent to about 30 percent of the weight of the head 10. In an exemplary embodiment, the aft-mass 24 weighs from about 40 grams to about 105 grams and makes up from about 13 percent to about 27 percent of the weight of the head 10. In another exemplary embodiment, the aft-mass 24 weighs about 70 grams and makes up about 20 percent of the weight of the head 10. The comparatively heavy weight of the aft-mass 24 allows the center of gravity CG to be moved rearward from the face portion 14.

The void 22 horizontally separates the face portion 14 from the aft-mass portion 18, and the void 22 vertically separates the cap 20 from the sole portion 16. The void 22, in conjunction with the aft-mass portion 18 and cap 20, allows for the center of gravity of the head 10, CG, to be moved rearward from the face portion 14. In an exemplary embodiment, the CG of the club head 10 is positioned within the void 22 and not positioned within material of the club head 10.

The CG may be located from about 0.4 inches and 0.8 inches from an external surface 26 of the sole portion 16. In an exemplary embodiment, the CG is located from about 0.5 inches and 0.7 inches from an external surface 26 of the sole portion 16. In another exemplary embodiment, the CG is located about 0.6 inches from the external surface 26 of the sole portion 16. Also, the CG may be located about 1.5 inches and 2.3 inches rearward from an external surface 28 of the face portion 14. In an exemplary embodiment, the CG is located from about 1.7 inches and 2.0 inches rearward from an external surface 28 of the face portion 14. In another exemplary embodiment, the CG is located about 1.8 inches rearward from the external surface 28 of the face portion 14.

In an exemplary embodiment, the external surface 30 of the aft-mass portion 18 defines at least one acute edge 32, 34 relative to the ground and a straight edge 36 relative to the ground. The aft-mass portion 18 extends outward from the sole portion 16. An internal surface 38 of the aft-mass portion 18 partially defines the void 22. The distance from the external surface 28 of the face portion 14 to the internal surface 38 of the aft-mass portion 18 may range from about 1.7 inches to about 3.1 inches. In an exemplary embodiment, the distance from the external surface 28 of the face portion 14 to the internal surface 38 of the aft-mass portion 18 ranges from about 2.0 inches to about 2.6 inches. In another exemplary embodiment, the distance from the external surface 28 of the face portion 14 to the internal surface 38 of the aft-mass portion 18 is about 2.3 inches.

The internal surface 38 of the aft-mass portion is generally perpendicular to the ground and may extend to the cap 20 or terminate between the sole portion 12 and cap 20. For example, the internal surface 38 may extend to the cap 20, providing a more solid feel to the putter. The external surface 26 of the sole portion 16 may contact the ground when the club head 10 is used with a shaft and grip, both not shown, as a putter. A portion of an internal surface 40 of the sole portion 16 partially defines the void 22. In an exemplary embodiment, the CG of the club head 10 lies above the sole portion 16.

The face portion 14 may have a thickness that ranges from about 0.05 inches to about 0.5 inches. In an exemplary embodiment, the face portion 14 has a thickness that ranges from about 0.15 inches to about 0.4 inches. In another exemplary embodiment, the face portion 14 has a thickness of about 0.2 inches. The face portion 14 has a width FW that may range from about 3.2 inches to about 4.5 inches. In an exemplary embodiment, the face portion 14 has a width FW that ranges from about 3.5 inches to about 4.2 inches. In another exemplary embodiment, the face portion 14 has a width FW of about 3.7 inches. The face portion 14 has an internal surface 54 that partially defines the void 22. In addition, the face portion 14 may include an insert or may be a non-insert type face, both of which are known in the art.

The cap 20 extends rearward from the face portion 14. The cap 20 has a central elongated section 42 and a front section 44. The front section 44 of the cap 20 increases in width from the heel end 46 to the toe end 47 as it extends rearward from the face portion 14, generally reaching a width CW'. The width CW' may range from about 3.5 inches to about 5.0 inches. In an exemplary embodiment, the width CW' ranges from about 3.8 inches to about 4.5 inches. In another exemplary embodiment, the width CW' is about 4.0 inches. In addition, the width CW' may range from about 7% to about 13% wider than the width, FW, of the face portion 14. The elongated section 42 of the cap 20, which extends rearward from the front section 44, gradually narrows as it extends rearward. The elongated section 42 may narrow to width CW" which is more narrow than both the width CW' and the width FW. The width CW" may range from about 1.0 inch to about 3.0 inches. In an exemplary embodiment, the width CW" ranges from about 1.6 inches to about 2.3 inches. In another exemplary embodiment, the width CW" is about 1.9 inches.

The cap 20 may have a thickness that ranges from about 0.03 inches to about 0.15 inches. In an exemplary embodiment, the cap 20 has a thickness that ranges from about 0.07 inches to about 0.12 inches. In another exemplary embodiment, the cap thickness is about 0.1 inches. As shown, the body 12 partially surrounds the cap 20. However, the cap 20 and body 12 also can be designed such that the cap 20 partially surrounds the body 12. The internal surface 48 of the cap 20 partially defines the void 22.

In an alternate embodiment of the present invention, the cap 20 is removable. It can be connected to the body 12 by connectors. For example any connector conforming to USGA standards may be used. With a removable cap 20, weight inserts may be utilized to change the weight of the head 10. For instance, the aft-mass portion 18 may have multiple removable weights made of brass, steel, tungsten, metal alloys, or the like. If a user encounters particularly fast or slow greens, the weight of the head 10 may be adjusted by removing the cap 20, removing or adding one or more weight inserts, and replacing the cap 20.

The external surface 50 of the cap 20 may have at least one alignment aid or alignment guide 52. The alignment aid(s) 52 may be any alignment aid, or combination of alignment aids 52, commonly used in the art. Such alignment aids 52 include lines, triangles, arrow heads, circles, and the like. In an exemplary embodiment, the external surface 50 includes alignment aids 52 of two lines and a center arrow head symbol. The lines are generally perpendicular to both the face portion 14 and the back of the elongated section 42. The distance between the lines is also approximately the same as the width CW". In an exemplary embodiment, the cap 20 is substantially flat on the external surface 50, thereby acting as an additional alignment guide by providing improved optical alignment when the external surface 50 is parallel to the ground.

The cap 20 has a length, L, which may be defined as the distance from the face portion 14 to the rearward most end of the aft mass portion 18 of the body 12 and the elongated section 42 of the cap 20. The length L may range from about 2.8 inches to about 4.3 inches. In an exemplary embodiment, the length L ranges from about 3.0 inches to about 3.7 inches. In another exemplary embodiment, the length L is about 3.3 inches. In yet another exemplary embodiment, the length L is approximately equal to FW. The ratio of FW to L may also conform to USGA standards.

The general shape of the cap 20 and head 10 generally acts as a guide to assist a user in alignment. Because CW' is greater than FW, a user may feel a greater sense of stability of the head 10. The generally tapering or narrowing of the elongated section 42 visually aids a user to generate a back stroke that travels straight back in line with the intended sight line or aim path. In addition, the shape of the head 10 may also lack rounded edges and alignment aids. While rounded edges tend to soften the overall look and feel of a head 10, they may not help a user to "square up," or align feet, hips, shoulders and eyes square to the intended sight line to a swing path or aim line. The elongated shape and extended sight lines, however, do help a user to square up. Further, because the width CW" is approximately equal to the width of a golf ball, the shape helps a user to more consistently contact the ball with the center area of the face portion 14, the sweet spot, thereby providing a more consistent roll.

Also, the general color of the cap 20 assists the user in that it can help to provide a greater sense that the user is square to the intended sight line. The cap 20 may be black or a similar dark color that provides a substantial contrast between the color of the ball (generally white) and the cap 20. Likewise, an exemplary embodiment has a substantial contrast between the alignment aids 52 and the cap 20.

Figure 7:
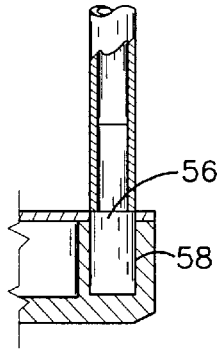
FIG. 7 is a side view of the interaction of the hosel and hosel hole of an embodiment of the putter head of the present invention.

A hosel 56 connects the head 10 to a putter shaft (not shown) at hosel hole 58. As shown, the head 10 has two hosel holes 58, one for left-handed heads 10 and one for right-handed heads 10. In addition, the hosel holes 58 are positioned toward the heel of the head 10. It will be understood that the head 10 can also be designed such that the hosel 56 connects more toward the center of the head 10, or closer to the center of the distance between the heel and the toe of the head 10. In addition, the hosel holes 58 may be rings such that shaft fits over an internal surface of the hosel holes 58, as shown in FIG. 7.

The hosel may be made of any one of or any combination of a variety of materials. For instance, it may be made of any of the materials suitable for the head 10, or any of the materials suitable for the cap 20. The hosel 56 may be made of either the first material or the second material, which has a lower density than the first material. Making the hosel 56 of the second material allows the CG to be moved farther toward the rear of the head 10. Suitable lower density hosel materials include, for example, carbon fiber, plastics, composite plastics, Kevlar, fiberglass, and the like. In an exemplary embodiment, the hosel 56 is a carbon fiber material. The hosel 56 may be connected to the head 10 by any means known in the art. In one exemplary embodiment, the hosel 56 is bonded to the head 10, providing a solid feel to the head 10 and more direct feedback to a user. More direct feedback and solid feel may provide a user with improved distance control.

As mentioned previously, the void 22 is defined by the internal surface 54 of the face portion 14, the internal surface 48 of the cap 20, the internal surface 40 of the sole portion 16 and the internal surface 38 of the aft-mass portion 18. The distance from the internal surface 48 of the cap 20 to the internal surface 40 of the sole portion 16 may range from about 0.01 inches to about 1.5 inches. In an exemplary embodiment, the distance from the internal surface 48 of the cap 20 to the internal surface 40 of the sole portion 16 ranges from about 0.5 inches to about 1.3 inches. In another exemplary embodiment, the distance is about 0.6 inches. The distance from the internal surface 54 of the face portion 14 to the internal surface 38 of the aft-mass portion 18 may range from about 1.5 inches to about 3.5 inches. In an exemplary embodiment, the distance from the internal surface 54 of the face portion 14 to the internal surface 38 of the aft-mass portion 18 ranges from about 1.8 inches to about 2.4 inches. In another exemplary embodiment, the distance is about 2.1 inches.

Figure 8:
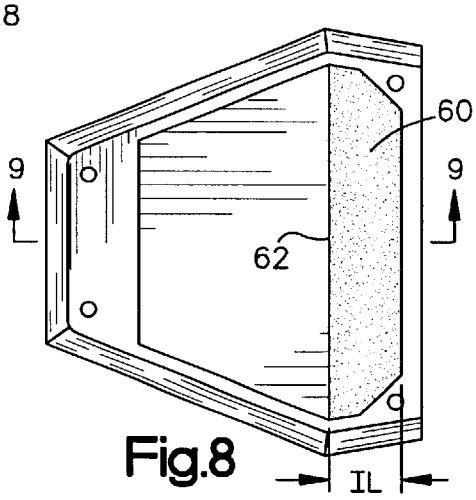
FIG. 8 is a top view of the body of an alternate embodiment of the putter head of the present invention.
Figure 9:
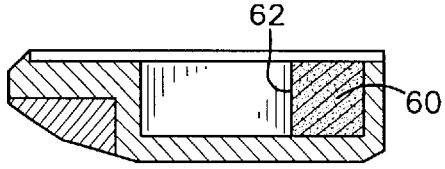
FIG. 9 is a side view of an alternate embodiment of the putter head of the present invention.

Turning now to FIGS. 8–9, an alternate embodiment of the putter head of the present invention is illustrated. The putter head 10 of FIGS. 7–9 is similar to that of FIGS. 1–6 except that it also includes an insert 60 between the face portion 14 and the aft-mass portion 18. The insert 60 may be positioned between the face portion 14 and the CG. In an exemplary embodiment, the insert 60 abuts the face portion 14, providing a more solid feel when the head 10 contacts a ball. The length (IL) of the insert 60 from the face portion 14 rearward may range from about 0.4 inches to about 1.0 inches. In an exemplary embodiment, the length IL ranges from about 0.6 inches to about 0.8 inches. In another exemplary embodiment, the length IL is about 0.7 inches. Both the length and width of the insert 60 may vary to achieve a desired CG position. To move the CG rearward, for example, the volume of insert 60 may be decreased.

The insert 60 may be at least partially composed of a material having a lower density than the first material. Suitable materials for the insert 60 include carbon fiber, plastics, composite plastics, Kevlar, fiberglass, and the like. In one embodiment, the insert 60 is made of the second material. The insert 60 may weigh from about 24 grams to about 61 grams and may make up from about 8 percent to about 12 percent of the weight of the head 10. In an exemplary embodiment, insert 60 weighs from about 36 grams to about 48 grams and makes up from about 12 percent to about 13 percent of the weight of the head 10. In another exemplary embodiment, the insert 60 weighs about 42 grams and makes up about 12 percent of the weight of the head 10. The comparatively light weight of the insert 60 allows the center of gravity CG to be moved rearward from the face portion 14.

Where the void 22 in the head 10 in FIGS. 1–6 is defined by the internal surface 54 of the face portion 14, the internal surface 48 of the cap 20, the internal surface 40 of the sole portion 16 and the internal surface 38 of the aft-mass portion 18, the void 22 in FIGS. 7–9 is defined by at least an internal surface 62 of the insert 60, the internal surface 48 of the cap 20, the internal surface 40 of the sole portion 16 and the internal surface 38 of the aft-mass portion 18. Where the insert does not extend from the heel to the toe of the head 10, the void 22 is defined by the internal surface 54 of the face portion 14, the internal surface 62 of the insert 60, the internal surface 48 of the cap 20, the internal surface 40 of the sole portion 16 and the internal surface 38 of the aft-mass portion 18. The distance from the internal surface 62 of the insert 60 to the internal surface 38 of the aft-mass portion 18 may range from about 1.2 inches to about 2.1 inches. In an exemplary embodiment, the distance from the internal surface 62 of the insert 60 to the internal surface 38 of the aft-mass portion 18 ranges from about 1.5 inches to about 1.9 inches. In another exemplary embodiment, the distance is about 1.6 inches.

While the present invention has been described in association with several exemplary embodiments, the described embodiments are to be considered in all respects as illustrative and not restrictive. Such other features, aspects, variations, modifications, and substitution of equivalents may be made without departing from the spirit and scope of this invention which is intended to be limited solely by the scope of the following claims. Also, it will be appreciated that features and parts illustrated in one embodiment may be used, or may be applicable, in the same or in a similar way in other embodiments.

What is claimed is:

1. A golf putter head comprising:

a body having a face portion, a sole portion and an aft-mass portion, the body being at least partially made from a first material; and a cap made from a second material, the second material having a lower density than the first material;

wherein the body and cap define a void and wherein the center of gravity of the golf putter head is within the void.

2. The golf putter head of claim 1 wherein the first material is at least one of: aluminum, steel, carbon steel, stainless steel, titanium, titanium alloy, bronze, and a metal alloy having a density greater than that of aluminum and less than that of steel.

3. The golf putter head of claim 1 wherein the second material is at least one of: a carbon fiber material, a plastic material, a composite material, and a fiberglass material.

4. The golf putter head of claim 1 wherein the body further comprises at least one aft-mass weight made from a third material that has a higher density than either the first material or second material.

5. The golf putter head of claim 4 wherein the at least one aft-mass weight is made from at least one of: brass, steel, and tungsten.

6. The golf putter head of claim 4 wherein the weight of the at least one aft-mass weight ranges from about 13 percent to about 27 percent of the weight of the head.

7. The golf putter head of claim 1 wherein the center of gravity is located from about 1.5 inches to about 2.3 inches from the back of the face portion.

8. The golf putter head of claim 1 wherein the center of gravity is located from about 0.4 inch to about 0.8 inch from the bottom of the sole portion.

9. The golf putter head of claim 1 wherein the distance from the external surface of the face portion to internal surface of the aft-mass portion ranges from about 2.0 inches to about 2.6 inches.

10. The golf putter head of claim 1 wherein the cap is substantially flat.

11. The golf putter head of claim 1 further comprising at least one alignment aid.

12. The golf putter head of claim 11 wherein at least one of the alignment aids is a line.

13. The golf putter head of claim 1 further comprising a non-metallic faceplate insert.

14. The golf putter head of claim 1 further comprising a hosel made from the second material.

15. The golf putter head of claim 1 further comprising an insert between front and aft-mass portions of the body, the insert being made of material having lower density than the first material.

16. The golf putter head of claim 15 wherein the insert is made of the second material.

17. The golf putter head of claim 15 further comprising a hosel bonded to the insert.

18. The golf putter head of claim 1 wherein the cap is removable.

19. The golf putter head of claim 18 further comprising at least one removable aft-mass weight made from a third material that has a higher density than either the first material or second material.

20. A golf putter head comprising:

a body having a face portion, a sole portion and an aft-mass portion, the body being at least partially made from a body material, the face portion being greater in width than the aft-mass portion, but less in width than the width of the putter head at its widest point;

a cap made from a light material, the light material having a lower density than the first material; and at least one aft-mass weight being made from a heavy material having a higher density than the body material;

wherein the body and cap define a void and wherein the center of gravity of the golf putter head is within the void.

* * * * *